US010051969B2

(12) United States Patent
Galloway

(10) Patent No.: US 10,051,969 B2
(45) Date of Patent: Aug. 21, 2018

(54) BED SHEET WITH AN INTEGRATED BODY POSITIONER

(71) Applicant: Nadia Galloway, Marietta, GA (US)

(72) Inventor: Nadia Galloway, Marietta, GA (US)

( * ) Notice: Subject to any disclaimer, the term of this patent is extended or adjusted under 35 U.S.C. 154(b) by 0 days.

(21) Appl. No.: 15/448,823

(22) Filed: Mar. 3, 2017

(65) Prior Publication Data

US 2017/0265647 A1 Sep. 21, 2017

Related U.S. Application Data

(60) Provisional application No. 62/308,306, filed on Mar. 15, 2016.

(51) Int. Cl.
*A47C 20/02* (2006.01)
*A47G 9/02* (2006.01)
*A47D 15/00* (2006.01)

(52) U.S. Cl.
CPC ..... *A47C 20/02* (2013.01); *A47D 15/008* (2013.01); *A47G 9/0246* (2013.01); *A47G 9/0238* (2013.01)

(58) Field of Classification Search
CPC ..... A47G 9/00; A47G 9/02; A47G 9/0207; A47G 9/0223; A47G 9/0238; A47G 9/0246; A47C 20/02; A47C 20/021; A47C 20/023; A47C 20/027
USPC .... 5/632, 630, 485, 482, 497, 495, 425, 424
See application file for complete search history.

(56) References Cited

U.S. PATENT DOCUMENTS 2,470,398 A * 5/1949 Hayes ..... A61G 7/065 5/624
3,843,980 A * 10/1974 Rodriguez ..... A47C 20/021 5/630
4,383,713 A * 5/1983 Roston ..... A47D 15/003 297/219.12
4,607,402 A * 8/1986 Pollard ..... A47C 21/08 5/425
4,754,509 A * 7/1988 Pollard ..... A47C 21/08 5/425
4,873,734 A 10/1989 Pollard
5,117,519 A * 6/1992 Thomas ..... A47C 27/05 112/475.08
5,189,748 A * 3/1993 Garrison ..... A47D 13/08 5/603
5,742,963 A * 4/1998 Trevino ..... A61G 1/00 128/845
5,916,089 A * 6/1999 Ive ..... A47D 15/006 297/219.12

(Continued)

*Primary Examiner* — Robert G Santos
(74) *Attorney, Agent, or Firm* — Asgaard Patent Services, LLC; F. Wayne Thompson, Jr.

(57) ABSTRACT

Implementations of a bed sheet with an integrated body positioner are provided. In some implementations, the integrated body positioner of the bed sheet may be padded and act as a pillow for the whole body. In some implementations, the bed sheet may comprise a sheet having an integrated body positioner. In some implementations, the body positioner may comprise a head portion, a torso portion, a first leg portion, a second leg portion, a first arm portion, and a second arm portion. In some implementations, the body positioner may further comprise a padded bumper positioned about the head portion. In some implementations, the integrated body positioner may not include leg portions and may further comprise an elevating foot portion. In some implementations, the elevating foot portion may be padded and configured to act as a pillow for a user's feet and/or ankles.

26 Claims, 5 Drawing Sheets

(56) References Cited

U.S. PATENT DOCUMENTS

| | | | | |
|---|---|---|---|---|
| 5,991,946 | A | 11/1999 | Harris | |
| 5,996,147 | A * | 12/1999 | Trimble | A47G 9/02 5/482 |
| D446,675 | S | 8/2001 | Straub | |
| 6,286,163 | B1 * | 9/2001 | Trimble | A47G 9/0246 5/485 |
| 6,415,466 | B1 | 7/2002 | Laiso | |
| 6,473,923 | B1 | 11/2002 | Straub | |
| 6,539,565 | B1 * | 4/2003 | Trimble | A47G 9/02 5/482 |
| 6,848,134 | B1 * | 2/2005 | Schenck | A61G 1/04 128/870 |
| 6,957,465 | B1 * | 10/2005 | Oprandi | A47C 27/001 5/500 |
| 7,334,279 | B2 * | 2/2008 | Oprandi | A47C 27/082 5/691 |
| 7,346,949 | B2 | 3/2008 | Kamrin-Balfour | |
| 7,356,863 | B2 * | 4/2008 | Oprandi | A47C 27/082 5/500 |
| 7,584,515 | B2 | 9/2009 | Jones | |
| 7,971,292 | B1 * | 7/2011 | Sithian | A47C 20/021 5/485 |
| 8,074,310 | B1 * | 12/2011 | Robbins | A47C 20/025 5/631 |
| 9,572,738 | B2 * | 2/2017 | Haworth | A61G 7/07 |
| 2007/0101505 | A1 * | 5/2007 | Oprandi | A47C 27/082 5/710 |
| 2007/0113349 | A1 * | 5/2007 | Oprandi | A47C 27/082 5/691 |
| 2009/0056017 | A1 * | 3/2009 | Jones | A47G 9/02 5/485 |
| 2014/0041122 | A1 * | 2/2014 | Haworth | A61G 7/07 5/632 |
| 2017/0265647 | A1 * | 9/2017 | Galloway | A47C 20/02 |

* cited by examiner

BED SHEET WITH AN INTEGRATED BODY POSITIONER

CROSS REFERENCE TO RELATED APPLICATION

This application claims the benefit of U.S. Patent Application Ser. No. 62/308,306, which was filed on Mar. 15, 2016, and is incorporated herein by reference in its entirety.

TECHNICAL FIELD

This disclosure relates to implementations of a bed sheet with an integrated body positioner.

BACKGROUND

The use of bed sheets and pillows is well known in the prior art. Bed sheets are typically used to cover a mattress and/or the occupant of a bed, while pillows are routinely used to support the head, neck and/or other parts of the body while sleeping or lying down. The prior art is crowded with examples of bed sheets and pillows that provide familiar, expected, and obvious structural configurations.

The American Academy of Pediatrics recommends placing infants on their backs to sleep because studies have shown that this reduces the risk of Sudden Infant Death Syndrome (SIDS). Wedges, loose pillows, and/or other devises may be used to position infants on their backs during sleep. However, wedges, loose pillows, and/or other devices placed into a crib to position an infant may become dislodged by the movement of the infant and thus become a safety hazard.

Research has also shown that adults should sleep on their backs. Sleeping in the supine position has been shown to reduce head and neck pain and allows the spine to rest in a neutral position. Also, sleeping in the supine position with the head elevated has been shown to reduce acid reflux and prevent asphyxiation.

Accordingly, it can be seen that needs exist for a bed sheet with an integrated body positioner. It is to the provision of a bed sheet with an integrated body positioner that is configured to comfortably and safely position infants, adolescents, and/or adults on their backs during sleep that the present invention is primarily directed.

SUMMARY OF THE INVENTION

Implementations of a bed sheet with an integrated body positioner are provided. In some implementations, the integrated body positioner of the bed sheet may be padded and act as a pillow for the whole body. In this way, a person (e.g., an infant, adolescent, and/or adult) resting thereon may be more comfortable. In some implementations, the integrated body positioner of the bed sheet may be used to securely position an infant thereon (e.g., in a face up sleeping position) without the need of wedges, loose pillows, or other similar positioning devices.

In some implementations, the bed sheet may comprise a sheet having an integrated body positioner. In some implementations, the sheet may be similar in construction and size as a fitted sheet. In this way, the bed sheet may be secured about a mattress.

In some implementations, the body positioner may comprise a head portion, a torso portion, a first leg portion and a second leg portion, and a first arm portion and a second arm portion. In some implementations, the body positioner may further comprise a padded bumper positioned about the head portion. In this way, for example, the head of an infant resting in the supine position on the body positioner may be prevented from turning to the side.

In some implementations, both the top side and the bottom side of the bed sheet may provide a suitable surface on which to lie. In this way, the bed sheet may be reversible.

In some implementations, the bed sheet with an integrated body positioner may not include a padded bumper that is positioned about the head portion.

In some implementations, the bed sheet with an integrated body positioner may not include leg portions and may further comprise an elevating foot portion. In some implementations, the elevating foot portion may be padded and configured to act as a pillow for a user's feet and/or ankles.

In some implementations, a single bed sheet may include a first and a second body positioner thereon. In this way, two people may sleep side-by-side on a single bed sheet.

In some implementations, the bed sheet with an integrated body positioner may be sized and constructed for use with any size mattress (e.g., crib, twin, full, queen, king, etc . . . ). In some implementations, the body positioner of the bed sheet may be sized and constructed for use by children, adolescents, and/or adults.

DETAILED DESCRIPTION

Figure 1A:
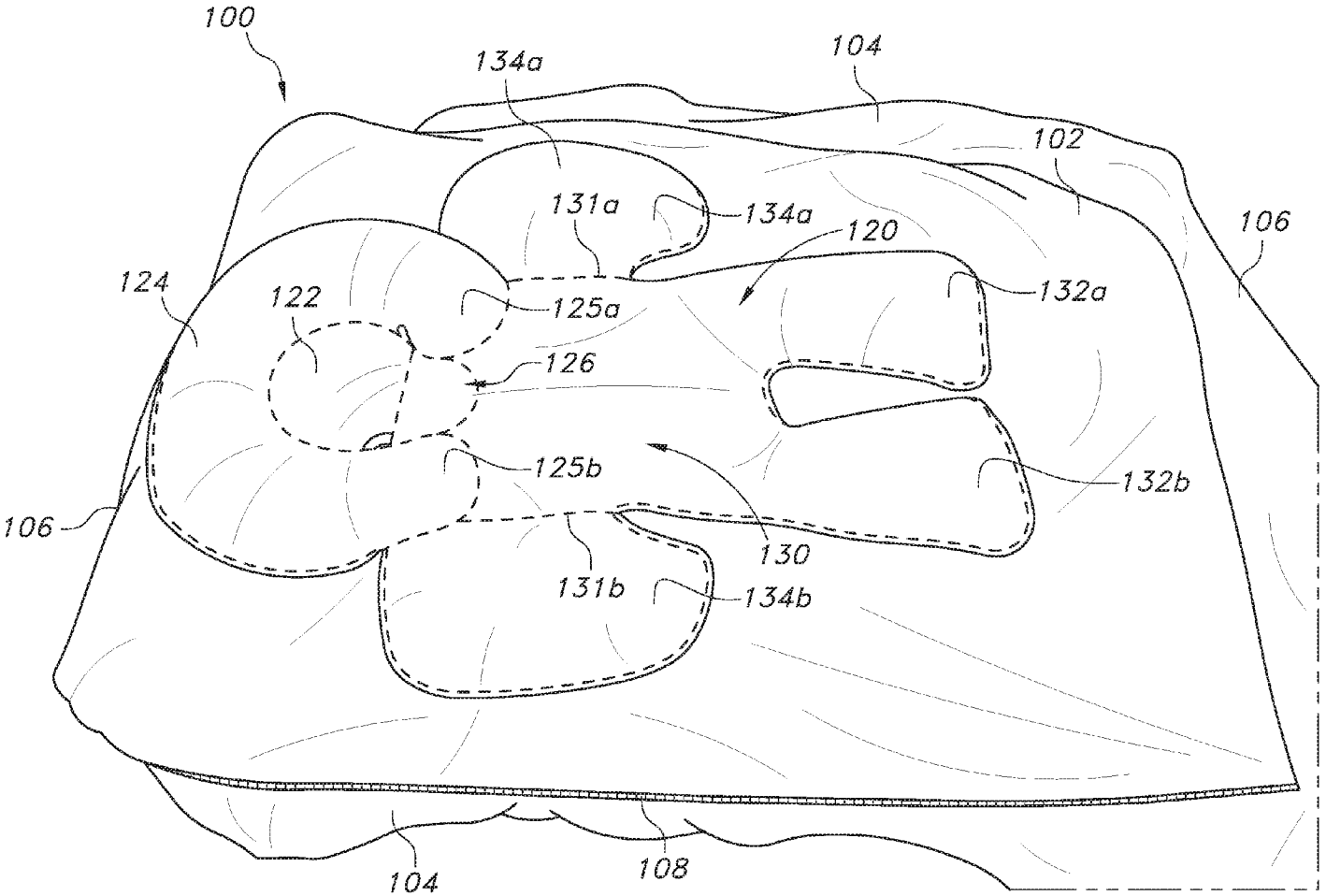
FIG. 1A illustrates a bottom side, perspective view of a bed sheet with an integrated body positioner according to the principles of the present disclosure.
Figure 1B:
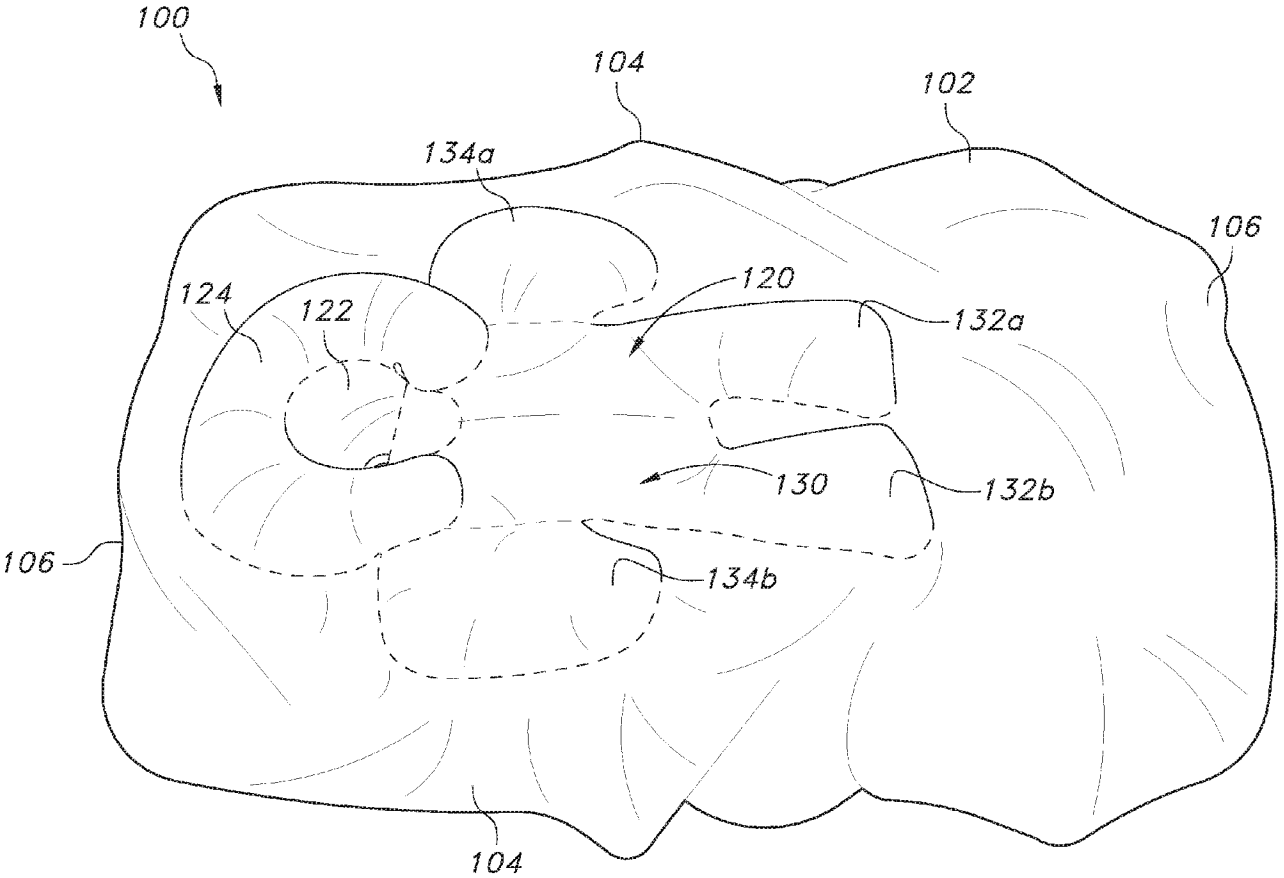
FIG. 1B illustrates a top side, perspective view of the bed sheet with an integrated body positioner shown in FIG. 1A.
Figure 2:
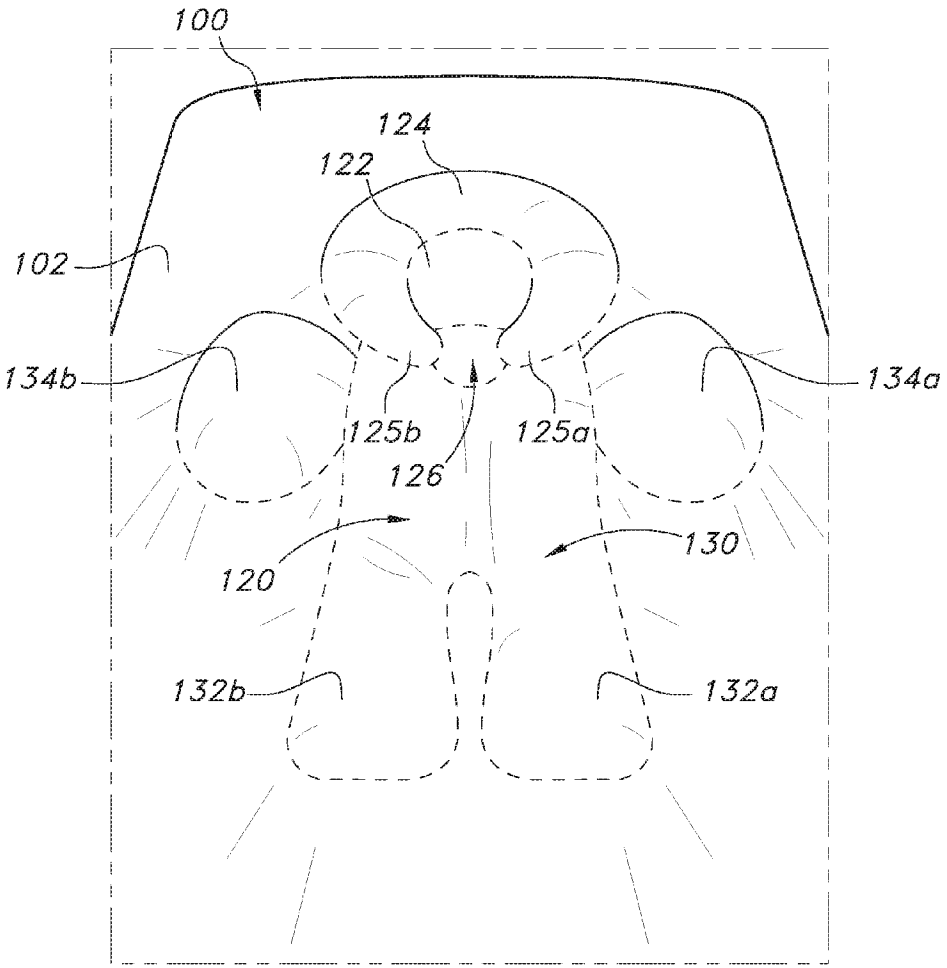
FIG. 2 illustrates a perspective view of the bed sheet shown in FIGS. 1A and 1B, wherein the bed sheet is secured about a mattress.

FIGS. 1A, 1B, and 2 illustrate an example implementation of a bed sheet 100 with an integrated body positioner. In some implementations, the integrated body positioner 120 of the bed sheet 100 may be padded and configured to act as a pillow for the whole body. In this way, a person (e.g., a child or an adult) resting thereon may be more comfortable. In some implementations, the integrated body positioner 120 of the bed sheet 100 may be used to securely position an infant thereon (e.g., in a face up sleeping position) without the need of wedges, loose pillows, or other similar positioning devices.

As shown in FIGS. 1A, 1B, and 2, in some implementations, the bed sheet 100 may comprise a sheet 102 having an integrated body positioner 120.

As shown in FIG. 1A, in some implementations, the sheet 102 may have a generally rectangular shape. In some implementations, the sheet 102 may be similar in construction and size as a fitted sheet. In some implementations, the sheet 102 may include side panels 104 and end panels 106 which are configured to closely fit the contours of a mattress (see, e.g., FIG. 2). In some implementations, the sheet 102 may include an elastic border 108 or hem on the side panels 104 and end panels 106 thereof. In this way, the sheet 102 may be secured about a mattress (see, e.g., FIG. 2).

In some implementations, the sheet 102 may be similar in construction and size as a non-fitted sheet (e.g., a flat sheet).

As shown in FIG. 1A, in some implementations, the body positioner 120 may comprise a head portion 122, a torso portion 130, a first leg portion 132*a* and a second leg portion 132*b* (collectively leg portions 132), and a first arm portion 134*a* and a second arm portion 134*b* (collectively arms portions 134). In some implementations, the body positioner 120 may have the general shape of a human body lying in the supine position. In some implementations, the body positioner 120 may further comprise a padded bumper 124 positioned about the head portion 122 (see, e.g., FIG. 1A). In this way, for example, the head of an infant resting in the supine position on the body positioner 120 may be prevented from turning to the side.

As shown in FIG. 1A, in some implementations, the head portion 122 of the body positioner 120 extends from a top side of the torso portion 130.

As shown in FIG. 1A, in some implementations, the first arm portion 134*a* and the second arm portion 134*b* extend from a first side 131*a* and a second side 131*b* of the torso portion 130 of the body positioner 120, respectively.

As shown in FIG. 1A, in some implementations, the first leg portion 132*a* and the second leg portion 132*b* each extend from a bottom side of the torso portion 130 of the body positioner 120.

As shown in FIG. 1A, in some implementations, the bumper 124 positioned about the head portion 122 may be "C" shaped. In this way, a gap 126 for an infant's neck is formed between a first end 125*a* and a second end 125*b* of the bumper 124. In some implementations, the bumper 124 may be any suitable shape. In some implementations, the bumper 124 may extend from the first arm portion 134*a*, about the head portion 122, to the second arm portion 134*b* of the body positioner 120 (see, e.g., FIG. 1A). In some implementations, the head portion 122 of the body positioner 120 may not have a bumper 124 positioned thereabout.

In some implementations, the body positioner 120 may be centered on the sheet 102. In some implementations, the body positioner 120 may not be centered on the sheet 102.

In some implementations, each portion of the body positioner 120 may be padded. In this way, the body positioner 120 provides a comfortable surface to lie upon. In some implementations, each portion of the body positioner 120 may comprise padding positioned between at least two layers of fabric which are sewn together along the edges. In this way, each portion of the body positioner 120 may be formed.

In some implementations, the body positioner 120 and the sheet 102 may be secured (i.e., integrated) together by any method of manufacture known to those of ordinary skill in the art.

In some implementations, both the top side (see, e.g., FIG. 1B) and the bottom side (see, e.g., FIG. 1A) of the bed sheet 100 may provide a suitable surface on which to lie. In this way, the bed sheet 100 may be reversible.

In some implementations, the sheet 102 may comprise one or more layers of material. In some implementations, the sheet 102 may be made of washable cotton or a cotton/polyester blend. In some implementations, the sheet 102 may be made of microfiber. In some implementations, the sheet 102 may be made of any synthetic, semi-synthetic, or natural fiber, or combination thereof, suitable for use as part of a bed sheet 100 with an integrated body positioner.

As shown in FIG. 2, in some implementations, the bed sheet 100 may be initially secured about a mattress (see, e.g., FIG. 2). Then, for example, an infant may be placed on its back upon the body positioner 120 for sleeping. The infant's torso may be rested upon the torso portion 130 of the body positioner 120, while the infant's head is rested on the head portion 122. In some implementations, this may result in the arms and legs of the infant coming to rest upon the arm portions 134 and leg portions 132 of the body positioner 102, respectively.

Figure 3:
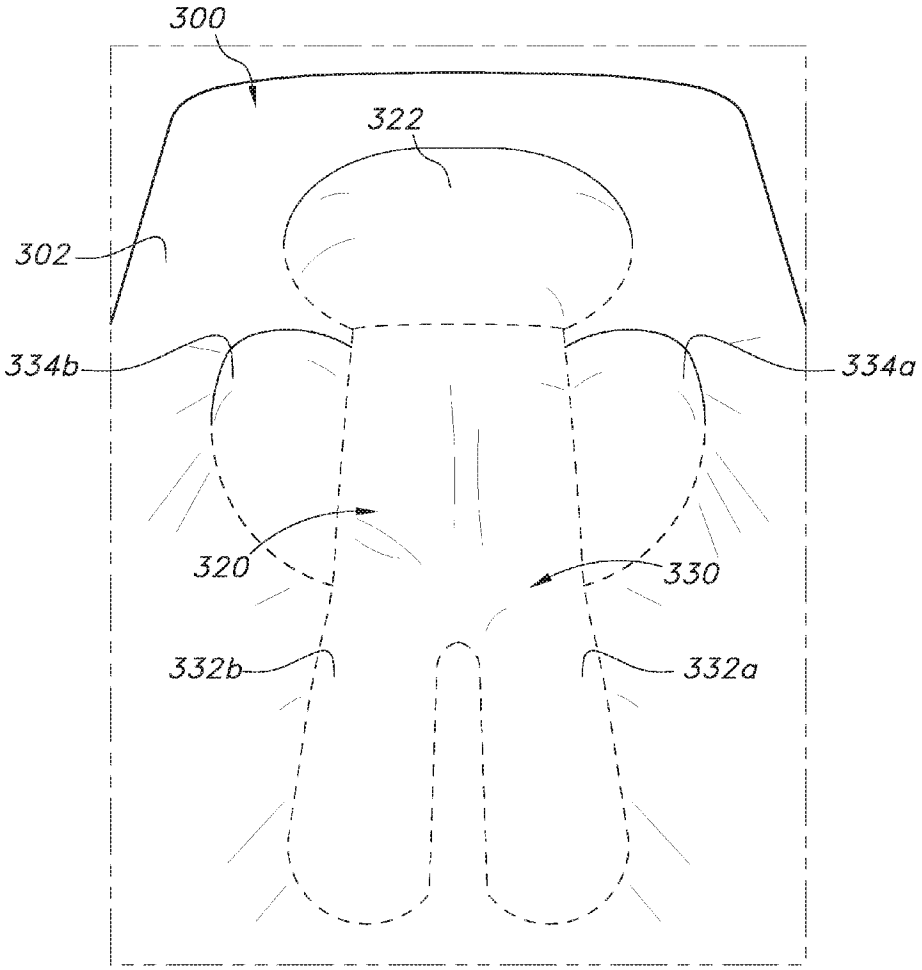
FIG. 3 illustrates another example implementation of a bed sheet with an integrated body positioner according to the principles of the present disclosure.

FIG. 3 illustrates another example implementation of a bed sheet 300 with an integrated body positioner in accordance with the present disclosure. In some implementations, the bed sheet 300 with an integrated body positioner is similar to the bed sheet 100 with an integrated body positioner discussed above but there is no padded bumper 124 positioned about the head portion 322. In some implementations, the head portion 322 of the bed sheet 300 is padded and configured to act as a pillow.

As shown in FIG. 3, in some implementations, the bed sheet 300 may comprise a sheet 302 having an integrated body positioner 320. In some implementations, the body positioner 320 may comprise a head portion 322, a torso portion 330, a first leg portion 332*a* and a second leg portion 332*b* (collectively leg portions 332), and a first arm portion 334*a* and a second arm portion 334*b* (collectively arms portions 334).

Figure 4:
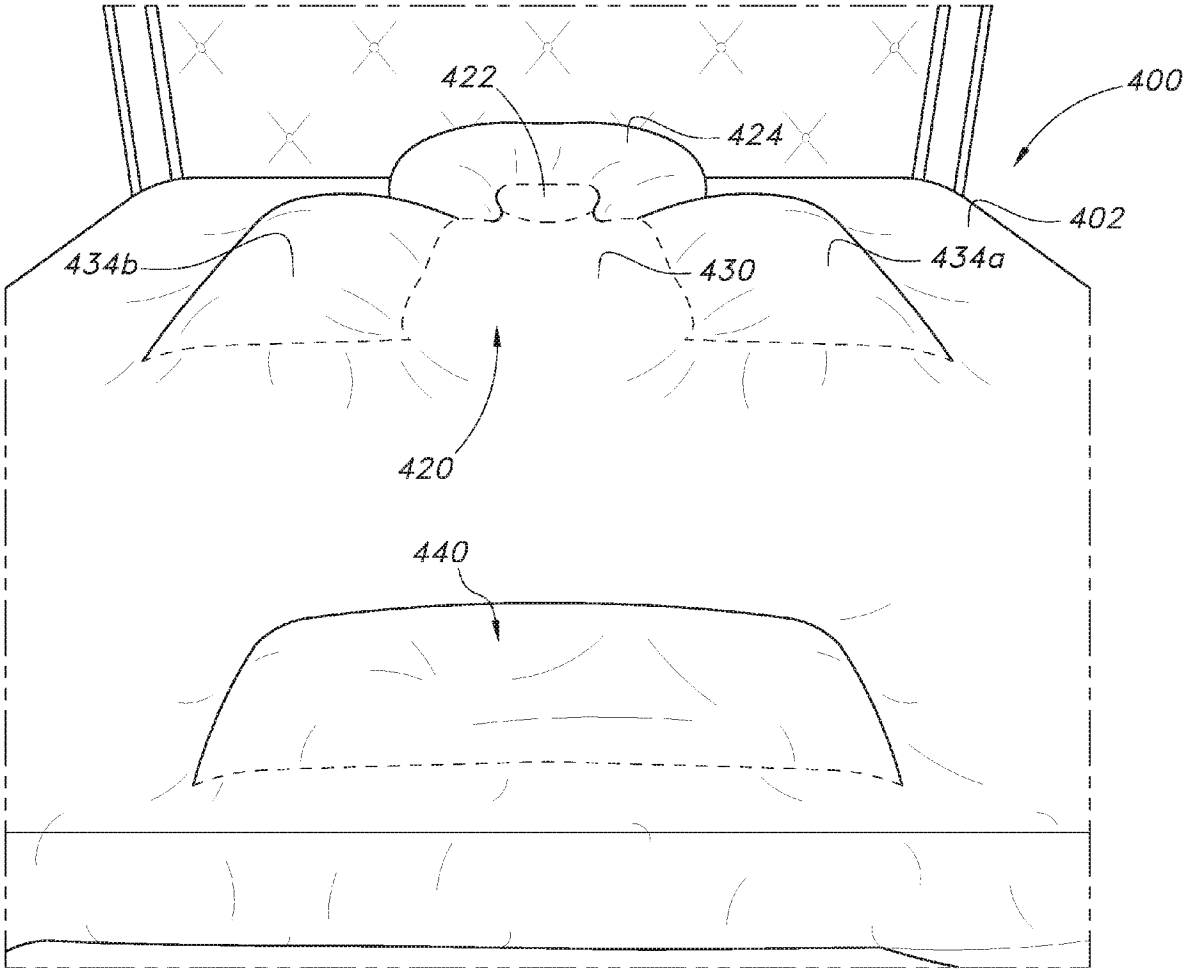
FIG. 4 illustrates yet another example implementation of a bed sheet with an integrated body positioner according to the principles of the present disclosure.

FIG. 4 illustrates yet another example implementation of a bed sheet 400 with an integrated body positioner in accordance with the present disclosure. In some implementations, the bed sheet 400 with an integrated body positioner is similar to the bed sheet 100, 300 with an integrated body positioner discussed above but the body positioner 420 may not include leg portions 132, 332 and may further comprise an elevating foot portion 440. In some implementations, the elevating foot portion 440 may be padded and configured to act as a pillow for a user's feet and/or ankles.

As shown in FIG. 4, in some implementations, the bed sheet 400 may comprise a sheet 402 having an integrated body positioner 420. In some implementations, the body positioner 420 may comprise a head portion 422, a torso portion 430, a first arm portion 434*a* and a second arm portion 334*b* (collectively arms portions 334), and an elevating foot portion 440. In some implementations, the body positioner 420 may further comprise a padded bumper 424 positioned about the head portion 422 (see, e.g., FIG. 4).

As shown in FIG. 4, in some implementations, the elevating foot portion 440 may have a generality rectangular shape. In some implementations, the elevating foot portion 440 may be any shape suitable for elevating the feet and/or ankles of a user.

In some implementations, a single bed sheet 400 may include a first and a second body positioner 420 thereon. In this way, two people may sleep side-by-side on a single bed sheet 400.

In some implementations, a single bed sheet 400 having a first and second body positioner 420 thereon may only include two arm portions 434. In some implementations, the first arm portion 434*a* may be positioned to the left of the first body positioner and the second arm portion 434*b* may be positioned to the right of the second body positioner. In this way, one arm portion 434 is positioned on the left and the right side of a sheet 402 having two integrated body positioners 400.

As used throughout the present specification, the term infant may be used interchangeably with the terms baby and/or child.

In some implementations, the bed sheet 100, 300, 400 with an integrated body positioner may be sized and constructed for use with any size mattress (e.g., crib, twin, full, queen, king, etc. . . . ). In some implementations, the body positioner 120, 320, 420 of the bed sheet 100, 300, 400 may be sized and constructed for use by children, adolescents, and/or adults.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A bed sheet with an integrated body positioner comprising:

a sheet having a width and a length, the sheet is configured to be secured about a mattress; and a body positioner comprising at least two layers of fabric each having a width and a length, the body positioner is secured to the sheet and includes a head portion, a torso portion, a first arm portion, and a second arm portion;

wherein each portion of the body positioner is configured to act as a pillow and comprises padding positioned between the at least two layers of fabric;

wherein the width and the length of the at least two layers of fabric of the body positioner are not coextensive with the width and the length of the sheet; and wherein the head portion extends from a top side of the torso portion, the first arm portion extends from a left side of the torso portion, and the second arm portion extends from a right side of the torso portion.

2. The bed sheet with the integrated body positioner of claim 1, wherein the body positioner also includes a first leg portion and a second leg portion that are spaced apart, the first leg portion and the second leg portion each extend from a bottom side of the torso portion; and wherein the body positioner has the general outline of a human body lying in a supine position.

3. The bed sheet with the integrated body positioner of claim 1, wherein the body positioner also includes a padded bumper positioned about the head portion.

4. The bed sheet with the integrated body positioner of claim 3, wherein the padded bumper is "C" shaped.

5. The bed sheet with the integrated body positioner of claim 3, wherein the padded bumper extends from the first arm portion, about the head portion, to the second arm portion.

6. The bed sheet with the integrated body positioner of claim 2, wherein the body positioner also includes a padded bumper positioned about the head portion.

7. The bed sheet with the integrated body positioner of claim 6, wherein the padded bumper is "C" shaped.

8. The bed sheet with the integrated body positioner of claim 6, wherein the padded bumper extends from the first arm portion, about the head portion, to the second arm portion.

9. The bed sheet with the integrated body positioner of claim 1, wherein the body positioner also includes a foot portion, the foot portion is spaced apart from a bottom side of the torso portion.

10. The bed sheet with the integrated body positioner of claim 3, wherein the body positioner also includes a foot portion, the foot portion is spaced apart from a bottom side of the torso portion.

11. A bed sheet with an integrated body positioner comprising:

a sheet having a width and a length, the sheet is configured to be secured about a mattress; and a body positioner comprising at least one layer of fabric having a width and a length, the body positioner comprises a head portion, a torso portion, a first arm portion, and a second arm portion;

wherein each portion of the body positioner is configured to act as a pillow, is secured to the sheet, and padding is positioned between the at least one layer of fabric and the sheet;

wherein the width and the length of the at least one layer of fabric of the body positioner is not coextensive with the width and the length of the sheet; and wherein the head portion extends from a top side of the torso portion, the first arm portion extends from a left side of the torso portion, and the second arm portion extends from a right side of the torso portion.

12. The bed sheet with the integrated body positioner of claim 11, wherein the body positioner also includes a first leg portion and a second leg portion that are spaced apart, the first leg portion and the second leg portion each extend from a bottom side of the torso portion; and wherein the body positioner has the general outline of a human body lying in a supine position.

13. The bed sheet with the integrated body positioner of claim 11, wherein the body positioner also includes a padded bumper positioned about the head portion.

14. The bed sheet with the integrated body positioner of claim 13, wherein the padded bumper is "C" shaped.

15. The bed sheet with the integrated body positioner of claim 13, wherein the padded bumper extends from the first arm portion, about the head portion, to the second arm portion.

16. The bed sheet with the integrated body positioner of claim 12, wherein the body positioner also includes a padded bumper positioned about the head portion.

17. The bed sheet with the integrated body positioner of claim 16, wherein the padded bumper is "C" shaped.

18. The bed sheet with the integrated body positioner of claim 16, wherein the padded bumper extends from the first arm portion, about the head portion, to the second arm portion.

19. The bed sheet with the integrated body positioner of claim 11, wherein the body positioner also includes a foot portion, the foot portion is spaced apart from a bottom side of the torso portion.

20. The bed sheet with the integrated body positioner of claim 13, wherein the body positioner also includes a foot portion, the foot portion is spaced apart from a bottom side of the torso portion.

21. A bed sheet with an integrated body positioner comprising:

a sheet having a width and a length, the sheet is configured to be secured about a mattress; and a body positioner comprising at least one layer of fabric having a width and a length, the body positioner comprises a head portion, a torso portion, a first arm portion, a second arm portion, and a padded bumper positioned about the head portion;

wherein the padded bumper, the first arm portion, and the second arm portion of the body positioner are configured to act as a pillow, are secured to the sheet, and padding is positioned between the at least one layer of fabric and the sheet;

wherein the width and the length of the at least one layer of fabric of the body positioner is not coextensive with the width and the length of the sheet; and wherein the head portion extends from a top side of the torso portion, the first arm portion extends from a left side of the torso portion, and the second arm portion extends from a right side of the torso portion.

22. The bed sheet with the integrated body positioner of claim 21, wherein the body positioner further comprises a foot portion, the foot portion is spaced apart from a bottom side of the torso portion; and wherein the foot portion is configured to act as a pillow, is secured to the sheet, and padding is positioned between the at least one layer of fabric and the sheet.

23. The bed sheet with the integrated body positioner of claim 21, wherein the padded bumper is "C" shaped.

24. The bed sheet with the integrated body positioner of claim 21, wherein the padded bumper extends from the first arm portion, about the head portion, to the second arm portion.

25. The bed sheet with the integrated body positioner of claim 22, wherein the padded bumper is "C" shaped.

26. The bed sheet with the integrated body positioner of claim 22, wherein the padded bumper extends from the first arm portion, about the head portion, to the second arm portion.

* * * * *